US011878832B2

(12) United States Patent
Kuroiwa et al.

(10) Patent No.: US 11,878,832 B2
(45) Date of Patent: Jan. 23, 2024

(54) BOTTLE-SHAPED CAN WITH CAP AND MANUFACTURING APPARATUS THEREOF

(71) Applicant: Daiwa Can Company, Chiyoda-ku (JP)

(72) Inventors: Keiji Kuroiwa, Sagamihara (JP); Shigeru Noto, Sagamihara (JP); Tomohiko Oyanagi, Sagamihara (JP)

(73) Assignee: Daiwa Can Company, Chiyoda-ku (JP)

( * ) Notice: Subject to any disclaimer, the term of this patent is extended or adjusted under 35 U.S.C. 154(b) by 674 days.

(21) Appl. No.: 17/043,243

(22) PCT Filed: Mar. 22, 2019

(86) PCT No.: PCT/JP2019/012164
§ 371 (c)(1),
(2) Date: Sep. 29, 2020

(87) PCT Pub. No.: WO2019/188813
PCT Pub. Date: Oct. 3, 2019

(65) Prior Publication Data

US 2021/0016915 A1 Jan. 21, 2021

(30) Foreign Application Priority Data

Mar. 30, 2018 (JP) ..... 2018-069078

(51) Int. Cl.
*B65D 1/02* (2006.01)
*B21D 51/26* (2006.01)
(Continued)

(52) U.S. Cl.
CPC ..... *B65D 1/0246* (2013.01); *B21D 51/2615* (2013.01); *B65D 1/0207* (2013.01); *B65D 41/325* (2013.01); *B65D 41/34* (2013.01)

(58) Field of Classification Search
CPC ..... B21D 51/2615; B21D 51/2623; B65D 1/0246; B65D 1/207; B65D 41/325; B65D 41/34
(Continued)

(56) References Cited

U.S. PATENT DOCUMENTS 2,157,896 A * 5/1939 Held ..... B65D 1/0276 220/DIG. 22
2,384,810 A * 9/1945 Calleson ..... B65D 7/04 413/4
(Continued)

FOREIGN PATENT DOCUMENTS

CN 102615212 A 8/2012
CN 110650893 A 1/2020
(Continued)

OTHER PUBLICATIONS

International Search Report dated Jun. 11, 2019 in PCT/JP2019/012164 filed on Mar. 22, 2019, 2 pages.

*Primary Examiner* — Ernesto A Grano
(74) *Attorney, Agent, or Firm* — Oblon, McClelland, Maier & Neustadt, L.L.P.

(57) ABSTRACT

A bottle-shaped can includes a cap having an excellent sealing ability but easy to be opened. A top section includes a leading end section as an upper end of a neck portion, a diametrically-largest section formed beneath the leading end section, a diametrically-shrunk section extending downwardly from the diametrically-largest section, and an outer circumferential wall section extending downwardly from the diametrically-shrunk section. The leading end section, the diametrically-largest section, and diametrically-shrunk section form a smooth curved surface. A curvature of the diametrically-largest section in a cross-section is zero or negative value, given that a curvature of the diametrically-shrunk section is positive value. A flexion section is formed
(Continued)

between the diametrically-shrunk section and the outer circumferential wall section. The outer diameter of the outer circumferential wall section in which the curvature is zero or negative value is larger than an outer diameter of the flexion section.

10 Claims, 8 Drawing Sheets

(51) Int. Cl.
*B65D 41/32* (2006.01)
*B65D 41/34* (2006.01)

(58) Field of Classification Search
USPC ..... 215/44
See application file for complete search history.

(56) References Cited

U.S. PATENT DOCUMENTS 5,718,352 A * 2/1998 Diekhoff ..... B65D 1/0207 220/604
5,779,424 A * 7/1998 Stoffel ..... B21D 51/2615 413/1
6,010,026 A * 1/2000 Diekhoff ..... B21D 51/40 215/44
6,010,028 A * 1/2000 Jordan ..... B65D 7/04 220/604
6,959,830 B1 * 11/2005 Kanou ..... B65D 1/42 215/44
7,497,350 B2 * 3/2009 Enoki ..... B65D 7/04 220/619
7,798,357 B2 * 9/2010 Hanafusa ..... B65D 1/0246 220/288
8,016,148 B2 * 9/2011 Walsh ..... B65D 1/0207 215/44
9,694,947 B2 * 7/2017 Olson ..... B65D 1/0207
10,040,593 B2 * 8/2018 Ross ..... B21D 51/40
10,518,940 B2 * 12/2019 Vanon ..... B65D 41/348
10,875,684 B2 * 12/2020 Ross ..... B65D 41/3428
11,459,223 B2 * 10/2022 Ross ..... B67B 3/2066
2005/0218140 A1 10/2005 Enoki et al.
2014/0008320 A1 * 1/2014 Hosoi ..... B21D 51/26 29/592
2020/0172282 A1 6/2020 Hasegawa et al.
2021/0016915 A1 1/2021 Kuroiwa et al.

FOREIGN PATENT DOCUMENTS

CN 210618740 U 5/2020
JP 2001-63715 A 3/2001
JP 2001-213417 A 8/2001
JP 2003-237752 A 8/2003
JP 2003-252321 A 9/2003
JP 2004-026306 A 1/2004
JP 2004-154862 A 6/2004
JP 2004-175386 A 6/2004
JP 2005-022663 A 1/2005
JP 2018-193101 A 12/2018

* cited by examiner

BOTTLE-SHAPED CAN WITH CAP AND MANUFACTURING APPARATUS THEREOF

TECHNICAL FIELD

The present invention relates to a resealable bottle-shaped can formed of metal material in which a cap is mounted onto a threaded neck portion, and a manufacturing apparatus thereof.

BACKGROUND ART

Bottle-shaped cans of this kind and caps thereof are made of metallic material such as a resin-coated aluminum alloy sheet. An opening or a pourer of a neck portion of the bottle-shaped can is closed by a cap. However, a clearance remains between the opening of the neck portion and the cap, and the neck portion may not be closed certainly by mealy contacting the cap as a metallic member to the opening of the neck portion also as a metallic member. According to the prior art, therefore, a resin sealing liner is affixed to an inner surface of the cap, and the sealing liner is elastically contacted to a curled portion formed on the opening of the neck portion so that the bottle-shaped can is closed tightly. Specifically, the curled portion is a hollow ring portion formed by folding the opening of the neck portion outwardly into two or three layers in such a manner as to confine an edge the neck portion therein.

The patent document 1 discloses a structure of a container mouth in which a curled portion is shaped into a specific shape. According to the teachings the patent document 1, a sealing ability of a cap can be ensured even if the cap is deformed by the internal pressure of a bottle-shaped can. Specifically, in the structure described in the patent document 1, an outer circumferential surface of the curled portion is shaped into a tapered surface so that an outer diameter of the curled portion is reduced downwardly from a diametrically-largest portion. That is, an outer profile of the curled portion described in the patent document 1 includes a straight section to which the sealing liner is contacted tightly in a cross-section along a plane passing through a center axis. Thus, in the structure described in the patent document 1, a portion of the sealing liner lower than the diametrically-largest portion of the curled portion is bent radially inwardly toward a center of the neck portion to be contacted tightly to the outer surface of the curled portion from radially outer side.

PRIOR ART DOCUMENT

Patent Literature

Patent Document 1: JP 2003-252321 A.

SUMMARY OF INVENTION

Technical Problem to be Solved by the Invention

Thus, in the structure described in the patent document 1, an outer diameter of the curled portion decreases downwardly from the diametrically-largest portion so that the curled portion has a sharply angled cross-sectional shape to be fitted tightly with the sealing liner. Therefore, a large torque is required to rotate the cap to dismount the cap. That is, in order to detach the sealing liner from the curled portion, it is necessary to expand a portion of the sealing liner contacted to the portion of curled portion below the diametrically-largest portion to a maximum diameter of the curled portion. To this end, not only a torque to lift the sealing liner in an axial direction but also a torque to expand the sealing liner are required to dismount the cap. If such a large torque is necessary to dismount the cap, merchantability of the bottle-shaped can may be reduced. For example, the opening torque required to dismount the cap may be reduced by reducing a length of the portion of curled portion below the diametrically-largest portion to reduce a length of the portion of the sealing liner situated radially inner side of the neck portion. In this case, however, a contact area of the sealing liner is reduced thereby reducing a sealing ability thereof.

The present invention has been conceived noting the foregoing technical problems, and it is therefore an object of the present invention to provide a bottle-shaped can having an improved cap which can close the bottle-shaped can tightly but which can be dismounted easily, and a manufacturing apparatus thereof.

Means for Solving the Problem

According to one aspect of the present invention, there is provided a bottle-shaped can with a cap, comprising: a neck portion on which a thread is formed, and on which the cap is mounted; and a curled portion formed on an upper end portion of the neck portion, to which a sealing member affixed to an inner surface of the cap is contacted tightly to seal the neck portion. The curled portion includes a smooth top section formed by folding an end portion of metallic seat forming the neck portion radially outwardly. In order to achieve the above-explained objective, the top section includes a leading end section as an upper end of the neck portion, a diametrically-largest section formed beneath the leading end section in which an outer diameter is largest, a diametrically-shrunk section extending downwardly from the diametrically-largest section in which an outer diameter is reduced gradually, and an outer circumferential wall section extending downwardly from the diametrically-shrunk section. The leading end section, the diametrically-largest section, and the diametrically-shrunk section form a smooth curved surface. A curvature of the outer circumferential wall section in a cross-section along a plane passing through a center axis of the neck portion is zero or negative value, given that a curvature of the diametrically-shrunk section is positive value. A flexion section is formed between the diametrically-shrunk section and the outer circumferential wall section. The outer diameter of the outer circumferential wall section in which the curvature is zero or negative value is larger than an outer diameter of the flexion section.

According to the present invention, the sealing member may be contacted closely to the surface of the curled portion from the leading end section to at least a portion below the flexion section of the outer circumferential wall section.

According to the present invention, the outer circumferential wall section in which the curvature is zero or negative value may be shaped into a tapered shape in which the outer diameter is gradually increased downwardly, or a curved shape expanding downwardly.

According to the present invention, a taper angle of the outer circumferential wall section in which the curvature is zero or negative value, or an angle between a tangent line at a curve starting point where the outer circumferential wall section starts expanding and the center axis may be equal to or larger than 1 degree but equal to or smaller than 15 degrees.

According to the present invention, an outer diameter of a lower sealing end as a lowest portion, to which the sealing member is contacted in the outer circumferential wall section shaped into the tapered shape or the curved shape expanding downwardly, may be equal to or larger than the outer diameter of the diametrically-largest section.

According to the present invention, a lower end arcuate section may be formed beneath the outer circumferential wall section, and a curvature of the lower end arcuate section may be positive value so that the cross-section of the lower end arcuate section along the plane passing through the center axis of the neck portion expands radially outwardly.

According to the present invention, the lower sealing end as the lowest portion to which the sealing member is contacted may be situated at a predetermined site of the surface of the lower end arcuate section.

According to the present invention, an outer diameter of the lower sealing end may be equal to or larger than the outer diameter of the diametrically-largest section.

According to another aspect of the present invention, there is provides a manufacturing apparatus of a bottle-shaped can with a cap, comprising: a neck portion on which a thread is formed, and on which the cap is mounted; and a curled portion formed on an upper end portion of the neck portion, to which a sealing member affixed to an inner surface of the cap is contacted tightly to seal the neck portion. The curled portion has a top section including a leading end section as an upper end of the neck portion, a diametrically-largest section formed beneath the leading end section in which an outer diameter is largest, a diametrically-shrunk section extending downwardly from the diametrically-largest section in which an outer diameter is reduced gradually, and an outer circumferential wall section extending downwardly from the diametrically-shrunk section. In order to achieve the above-explained objective, the manufacturing apparatus comprises a forming tool that pushes a cylindrical folded portion bent outwardly from the neck portion toward an outer circumferential surface of the neck portion to form the curled portion. The forming tool includes an inner tool that is inserted into the neck portion to maintain a shape of the neck portion from inside, and an outer tool that pushes the folded portion toward the neck portion from radially outer side. The inner tool includes a shaft portion which is inserted into the neck portion, and an annular flat portion to which a leading end of the folded portion formed on the neck portion is contacted. The outer tool includes a projection that is isolated from the annular flat portion at a distance wider than a length between the leading end section and the diametrically-largest section in a direction along a center axis of the neck portion, and that pushes the folded portion toward the neck portion from radially outer side. The neck portion engaged with the inner tool is rotated along the outer tool to form the curled portion.

Advantageous Effects of Invention

Thus, in the bottle-shaped can according to the present invention, the top section as the upper end of the neck portion includes the leading end section, the a diametrically-largest section formed beneath the leading end section, and the diametrically-shrunk section extending downwardly from the diametrically-largest section. The leading end section, the diametrically-largest section, and diametrically-shrunk section form the smooth curved surface, and the sealing member affixed to the cap is contacted to those sections wile being deformed elastically. Therefore, a part of the sealing member is contacted to the portion below the diametrically-largest portion that is situated radially inside of the diametrically-largest section. For this reason, the sealing member is brought into contact tightly to the curled portion to seal the neck portion tightly, even if the cap is deformed upwardly by a pressure rise in the bottle-shaped can. The outer circumferential wall section extending downwardly from the diametrically-shrunk section via the flexion section is not shrunk diametrically toward an inner circumferential side of the neck portion, but is shaped into a cylindrical shape or expanded outwardly. Therefore, the sealing member being contacted to the outer circumferential wall section is not situated radially inner side of the flexion section. In other words, an area of the sealing member contacted to the curled portion (i.e., dimension of the neck portion in the radial direction) does not exceed an area (i.e., dimension) of the sealing member contacted to the portion from the diametrically-largest section to the flexion section. That is, it is not necessary to expand the sealing member significantly in the radial direction, therefore, a required torque to open the cap will not be increased. In addition, since the sealing member is also contacted tightly to the outer circumferential wall section, a sufficient contact area of the sealing member to the curled portion can be ensured to enhance the sealing ability. According to the present invention, therefore, the sealing ability of the cap can be enhanced but the cap can be dismounted easily.

According to the present invention, the outer circumferential wall section may be shaped into a tapered shape or a curved shape expanding downwardly. In this case, a radial load of the sealing member contacted to the curled portion or the neck portion is received by a lowest end portion of the diametrically-largest section and the outer circumferential wall section, and by the lower end arcuate section formed beneath the outer circumferential wall section. That is, a portion of the sealing member expanding radially inwardly comes into contact to the flexion section. Such portion of the sealing member expanding radially inwardly is contacted tightly to the diametrically-shrunk section, the flexion section, and the outer circumferential wall section, but a large fastening force is not applied to the curled portion or the neck portion. That is, when dismounting the cap from the neck portion, only the portion of the sealing member expanding inwardly has to be expanded radially outwardly. Therefore, a large torque is not required to rotate the cap. Especially, since the fastening force of the sealing member is received by the diametrically-largest section and the outer circumferential wall section or the lower end arcuate section, it is not necessary to expand the sealing member radially outwardly when a static friction is generated in an initial phase of rotation of the cap. Therefore, the torque required to rotate the cap will not be increased. After the cap starts rotating, the friction acting between the cap and the neck portion turns into kinetic friction. Therefore, although it is necessary to expand the sealing member expanding toward the flexion section, a torque greater than the torque at the initial phase is not required to further rotate the cap. According to the present invention, therefore, the torque to rotate the cap will not be increased excessively.

According to another aspect of the present invention, the folded portion formed on the opening end of the neck portion is pushed by the manufacturing apparatus toward the neck portion from radially outer side to be shaped into the curled portion. In the forming apparatus, the inner tool is inserted into the neck portion, and the neck portion is rotated along the outer tool together with the inner tool so that the folded portion is pushed by the protrusion of the outer tool. In this situation, specifically, the leading end of the neck portion is brought into contact to the annular flat portion of the inner tool, and the inner tool and the neck portion are rotated integrally. That is, the lading end portion of the neck portion does not slide on the inner tool, and hence the curled portion will not be damaged. In addition, since the projection of the outer tool merely pushes the folded portion in the radial direction, the folded portion not slide on the outer tool too. Therefore, damage of the curled portion may be reduced. Further, the annular flat portion of the inner tool and the projection of the outer tool are isolated away from each other in the direction along the center axis of the neck portion, and a clearance between the annular flat portion of the inner tool and the projection of the outer tool is equal to or wider than a length between the leading end section and the diametrically-largest section. That is, the projection of the outer tool pushes a leading (or lower) end portion of the folded portion. Consequently, the leading end portion of the curled portion will not be compressed completely and a portion bulging radially outwardly remains on the leading end portion of the curled portion. That is, the diametrically-largest section is formed on the curled portion. As described, the sealing ability of the cap may be enhanced by the diametrically-largest section, and the cap is allowed to be rotated easily by the diametrically-largest section. Therefore, in the bottle-shaped can manufactured by the manufacturing apparatus according to the present invention, the sealing ability of the cap is enhanced, and the cap can be rotated easily.

DESCRIPTION OF EMBODIMENT(S)

Figure 1:
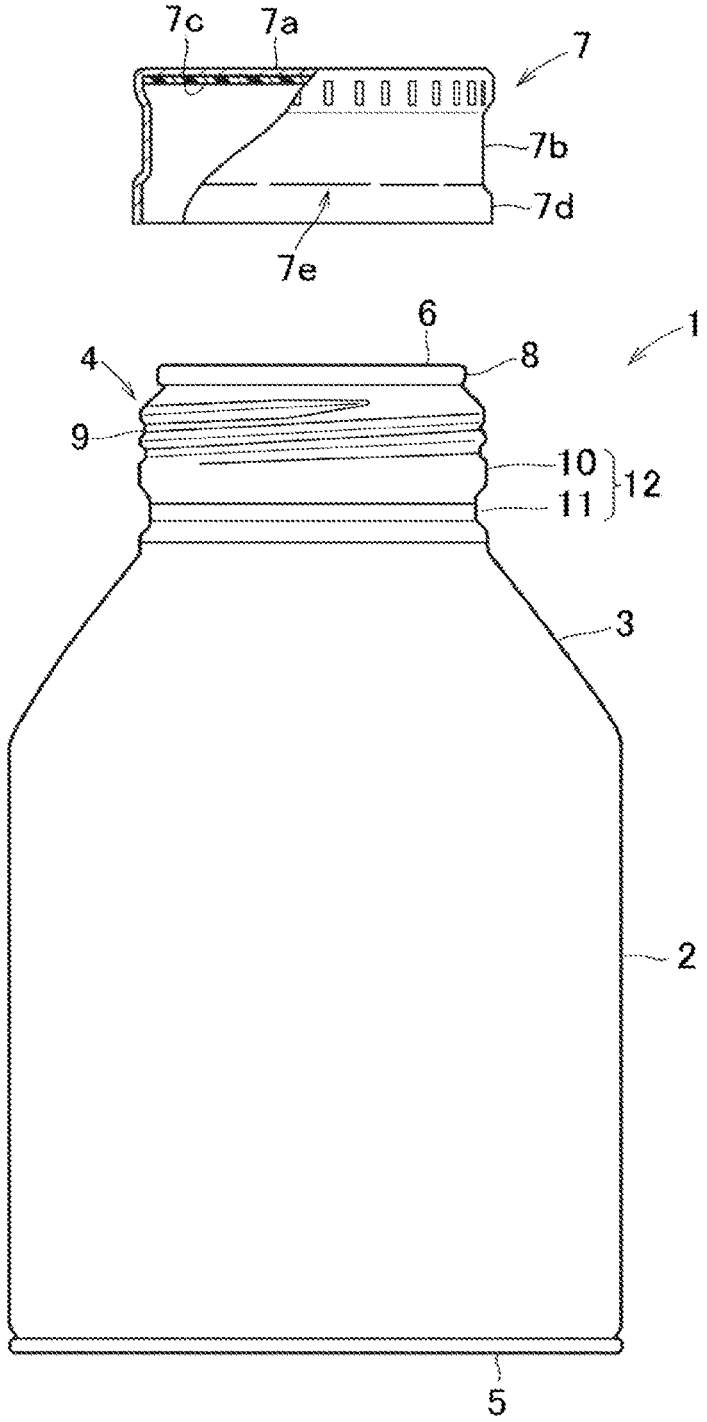
FIG. 1 is a front view showing one example of a bottle-shaped can according to the present invention.

A bottle-shaped can according to the present invention is made of metallic material such as a surface treatment steel sheet and an alloy-coated steel sheet. The surface treatment steel sheet includes an aluminum sheet, an aluminum alloy sheet, a tin free steel sheet and so on. The alloy-coated steel sheet includes a tin sheet, a chrome-coated steel sheet, an aluminum-coated steel sheet, a nickel-coated steel sheet and so on. At least one surface of the metallic material to be shaped into an inner surface of the bottle-shaped can is coated with a thermoplastic resin or a coating material. One example of the bottle-shaped can is shown in FIG. 1. A bottle-shaped can 1 shown therein comprises a diametrically-larger cylindrical trunk portion 2 as a main body, a shoulder portion 3 formed continuously from an upper end of the trunk portion 2, and a diametrically-smaller cylindrical neck portion 4 formed continuously from an upper end of the shoulder portion 3 to be situated on a center portion of the shoulder portion 3. A bottom lid 5 is seamed to a bottom of the bottle-shaped can 1. The neck portion 4 has an opening 6 on its leading end portion, and a cap 7 is mounted on the neck portion 4 to close the opening 6. In order to use the opening 6 of the neck portion 4 as a container mouth, a curled portion 8 having a round or an oval cross-section is formed on the opening 6 by folding an opening edge of the neck portion 4 outwardly into two or three layers in such manner as to confine the edge in the curled portion 8. A thread 9 as a male thread is formed on the neck portion 4 so that the cap 7 is mounted on the neck portion 4 in a resealable manner.

A material of the cap 7 mounted on the neck portion 4 comprises a top panel 7*a* and a cylindrical skirt portion 7*b*, and a liner 7*c* is affixed to an inner surface of the cap 7 (i.e., the top panel 7*a*). A circumferential corner of the top panel 7*a* is swaged, and a thread groove is formed on the skirt portion 7*b* by pressing the skirt portion 7*b* by a thread roller (not shown) along a thread 9 of the neck portion 4. The liner 7*c* is formed by applying elastic resin to the inner surface (and in the vicinity thereof). Therefore, the liner 7*c* is brought into close contact to the curled portion 8 by swaging the circumferential corner of the top panel 7*a* so that the opening 6 of the neck portion 4 is sealed tightly. An easily breakable portion 7*e* includes horizontal slits and bridges formed alternately in a circumferential direction on a lower portion of a skirt portion 7*b* of the cap 7, and a pilfer-proof band 7*d* is detached from the skirt portion 7*b* by rupturing the bridges.

An annular bead (or emboss) 10 is formed below the thread 9, and an annular groove 11 is formed below the bead 10. The bead 10 and the groove 11 are also called the stepped portion 12.

Figure 2:
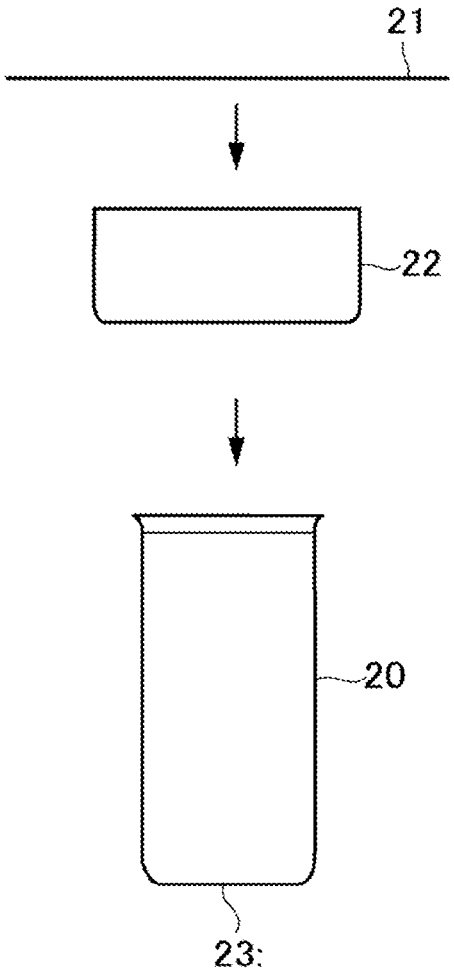
FIG. 2 is a schematic illustration showing a step of forming a can trunk in a manufacturing process.
Figure 3:
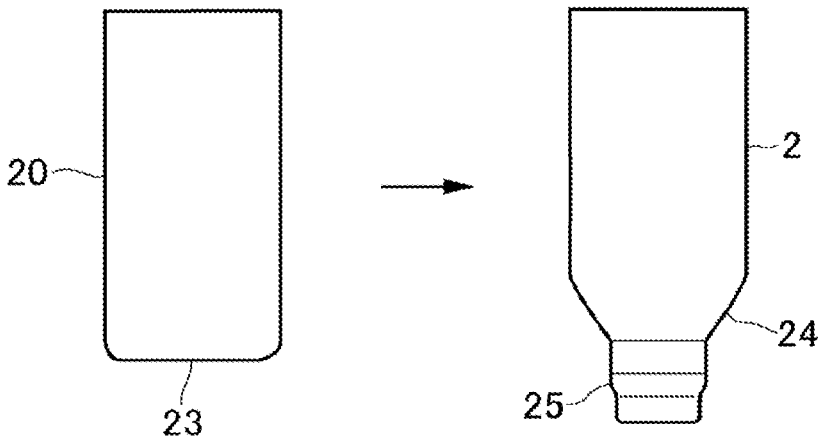
FIG. 3 is a schematic illustration showing steps of forming a shoulder portion and a diametrically-smaller cylindrical portion in the manufacturing process.

Here will be explained a manufacturing process of the trunk portion 2 and the neck portion 4 of the bottle-shaped can 1. Turning to FIG. 2, there is shown a forming process of a can trunk 20 as an intermediate product. First of all, a blank 21 is punched out of a thin metallic sheet material, and the blank 21 is drawn into a shallow cup-shaped interim product 22. Thereafter, the interim product 22 is shaped into the can trunk 20 having an outer diameter corresponding to that of the aforementioned trunk portion 2 by further applying a drawing and ironing to the interim product 22. In this phase, as illustrated in FIG. 3, the can trunk 20 has a bottom 23. A center portion of the bottom 23 is drawn and ironed to be gradually stretched while reducing a diameter of a circumferential corner of the bottom 23. As a result, a shoulder portion 24 and a diametrically-smaller cylindrical portion 25 are formed.

Figure 4:
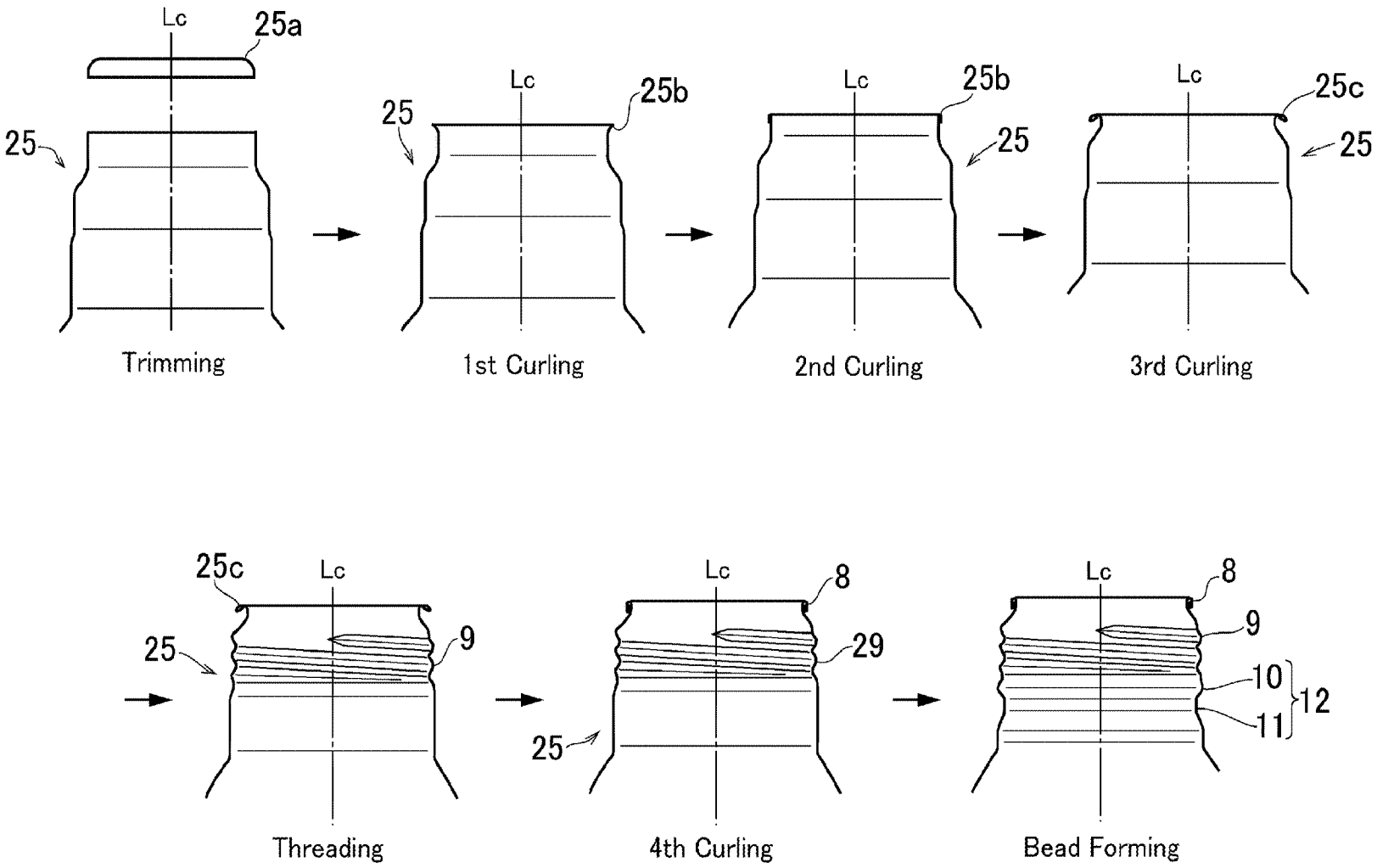
FIG. 4 is a process chart showing a trimming step, a curling step, a threading step, and a bead forming step.

The diametrically-smaller cylindrical portion 25 is to be shaped into the neck portion 4, and for this purpose, the diametrically-smaller cylindrical portion 25 is further processed to have a capping function and a tamper-evidence function. A forming process of the neck portion 4 is schematically shown in FIG. 4. First of all, in order to form a container mouth on a leading end portion 25*b* of the diametrically-smaller cylindrical portion 25, a bottom 25*a* is cut out (at a trimming step) to form an opening. In order to confine a sharp opening edge inside of the curled portion having a round cross-section, the opening edge of the diametrically-smaller cylindrical portion 25 is folded outwardly into e.g., three layers. According to the example shown in FIG. 4, the curled portion is formed by four curling steps. At the first curling step, the leading end portion 25*b* having the opening edge is bent outwardly to form a flange, and at the second curling step, the flange is further bent downwardly so that a folded portion 25*c* of two layers is formed. Then, at the third curling step, the two-layered folded portion 25*c* is bent outwardly so as to form a flange of two layers. Thereafter, at the fourth curling step, the two-layered folded portion 25*c* thus formed into the flange is further folded (or curled) downwardly outwardly so that the opening edge of the two-layered folded portion 25*c* is confined in the curled portion.

During the forming process of the curled portion, a threading is executed, and a bead forming is executed after the threading (e.g., after the final curling step) to provide the tamper evidence function. In other words, the curling process is completed after the threading step, and then the bead forming step is executed.

Figure 5:
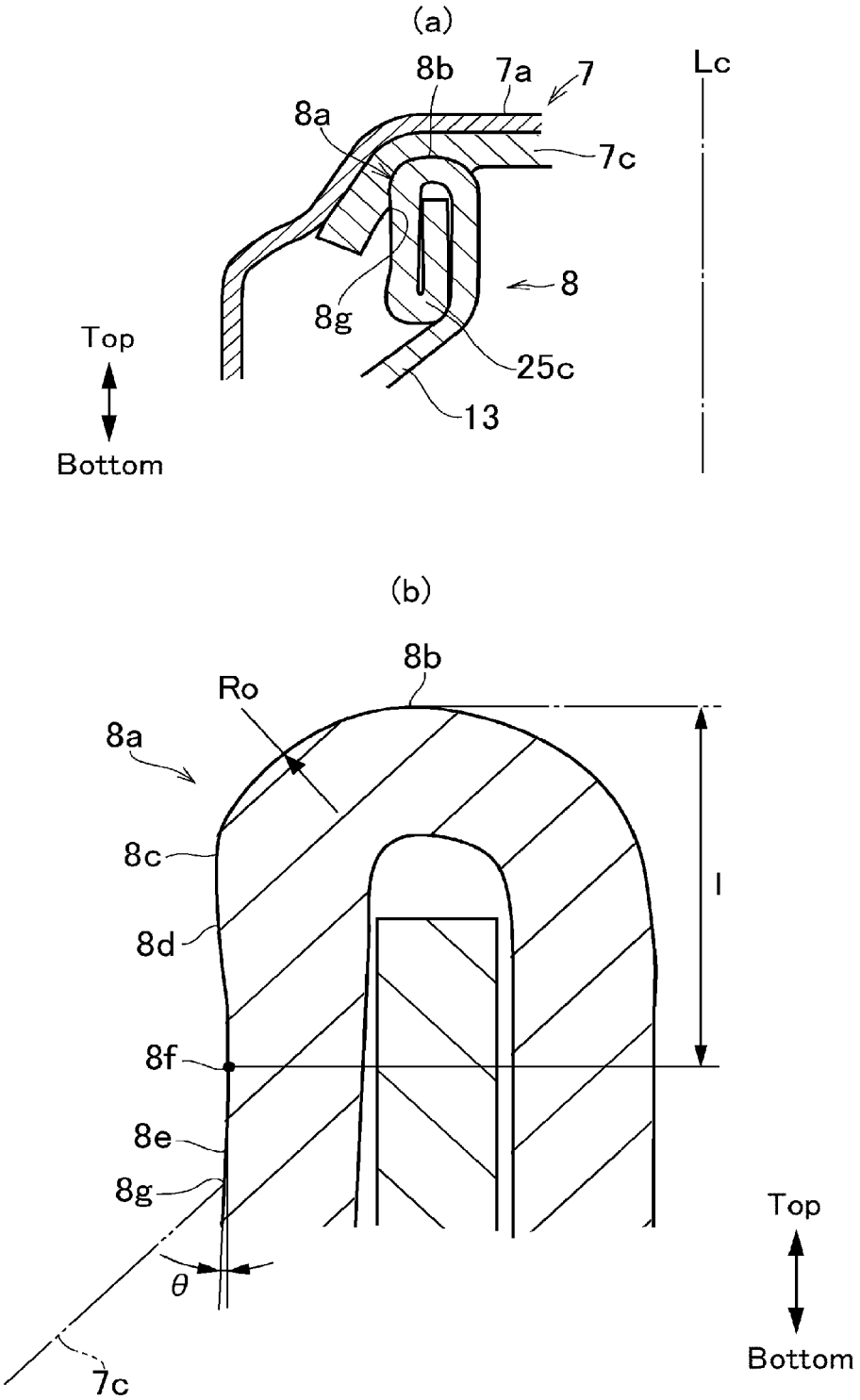
FIG. 5(*a*) is a partial cross-sectional view showing one example of the curled portion of the bottle-shaped can according to the present invention, and FIG. 5(*b*) is a partially enlarged cross-sectional view showing the curled portion shown in FIG. 5(*a*).

The curled portion 8 formed by the above-explained four steps will be explained in more detail. One example of the curled portion 8 according to the present invention is shown in FIG. 5, in which FIG. 5(*a*) shows the cap 7 is mounted on the neck portion 4, and FIG. 5(*b*) shows a portion of the curled portion 8 in an enlarged scale. As described, the curled portion 8 is formed by folding the opening edge of the diametrically-smaller cylindrical portion 25 outwardly so that a top section 8*a* of the curled portion 8 is curved smoothly at a predetermined curvature to have a predetermined width (i.e., thickness), and to form a leading end section 8*b*. A surface of the top section 8*a* bulges from the leading end section 8*b* toward radially outwardly and downwardly. Specifically, the top section 8*a* has an arcuate cross-section along a plane passing through a center axis Lc of the neck portion 4. The arcuate surface of the top section 8*a* extends downwardly from a diametrically-largest section 8*c* at which an outer diameter of the top section 8*a* is largest. That is, a portion of the outer surface of the top section 8*a* below the diametrically-largest section 8*c* is situated radially inner side of the diametrically-largest section 8*c*. The portion of the top section 8*a* situated radially inner side of the diametrically-largest section 8*c* will be called the diametrically-shrunk section 8*d*.

An outer circumferential wall section 8*e* is formed at a portion predetermined distance lower than the diametrically-largest section 8*c*. That is, the outer circumferential wall section 8*e* extends downwardly from the diametrically-shrunk section 8*d*. A curvature of the outer circumferential wall section 8*e* is different from a curvature of a portion in the vicinity of the diametrically-largest section 8*c*. Specifically, given that the curvature of the portion in the vicinity of the diametrically-largest section 8*c* (in the cross-section along the plane passing through the center axis Lc, same is applied in the following explanation) is "positive" value, the curvature of the outer circumferential wall section 8*e* is "0" or "negative" value. That is, the curvature is changed at a flexion section 8*f*. For example, given that a thickness of the curled portion 8 is approximately 0.3 mm, a curvature radius R0 of a portion from the leading end section 8*b* to the flexion section 8*f* via the diametrically-largest section 8*c* and the diametrically-shrunk section 8*d* is approximately 0.2 mm to 1 mm, and a length 1 from the leading end section 8*b* to the flexion section 8*f* along the center axis Lc is approximately 0.1 mm to 1.5 mm. The flexion section 8*f* may also be formed into an arcuate shape whose center of curvature is situated outside of the top section 8*a*. Instead, the flexion section 8*f* may also be formed into a complex arcuate shape including arcuate portions having different curvatures. In those cases, for example, a curvature radius of the flexion section 8*f* is approximately 0.5 mm to 5 mm.

The outer circumferential wall section 8*e* is a substantially straight portion extending along the center axis Lc whose curvature is "0" or substantially "0". Specifically, an angle θ between a generatrix of an upper end of the outer circumferential wall section 8*e* beneath the flexion section 8*f* (i.e., a vertical tangent line in the cross-section along the plane passing through the center axis Lc) and the center axis Lc is 0 to 15 degrees. That is, the outer circumferential wall section 8*e* is shaped into a cylindrical shape or a tapered shape in which an outer diameter thereof increases toward a lower portion. Preferably, a taper angle of the outer circumferential wall section 8*e* is set within a range from 1 degree to 30 degrees. More preferably, a taper angle of the outer circumferential wall section 8*e* is set within a range from 1 degree to 15 degrees. If the taper angle of the outer circumferential wall section 8*e* is wider than 30 degrees, the liner 7*c* may not be contacted tightly to the diametrically-shrunk section 8*d*.

The outer circumferential wall section 8*e* is not necessarily to be shaped accurately into the tapered shape. According to the present invention, the outer circumferential wall section 8*e* may also be shaped into a curved shape (expanding downwardly) similar to the tapered shape. In this case, an angle between the tangent line at a curve starting point of the present invention at which the outer circumferential wall section 8*e* starts expanding and the center axis Lc corresponds to the aforementioned taper angle. As the aforementioned taper angle, according to the present invention, the angle at the curve starting point is also set within a range from 1 degree to 30 degrees. Preferably, the angle at the curve starting point is set within a range from 1 degree to 15 degrees.

A corner portion of the cap 7 is swaged to the vicinity of an intermediate portion of the curled portion 8 of the neck portion 4 in the vertical direction so that the liner 7*c* is contacted closely to the outer circumferential wall section 8*e* over to a portion far below the flexion section 8*f*. A lower end of the portion of the outer circumferential wall section 8*e* to which the liner 7*c* is contacted will be called a lower sealing end 8*g*. Given that the outer circumferential wall section 8*e* is shaped into a cylindrical shape, an outer diameter of the lower sealing end 8*g* is identical to an outer diameter of the flexion section 8*f*. By contrast, given that the outer circumferential wall section 8*e* is shaped into a tapered shape or a curved shape expanding downwardly, the outer diameter of the lower sealing end 8*g* is increased to be larger than the outer diameter of the flexion section 8*f*, and to be identical to or greater than an outer diameter of the diametrically-largest section 8*c*, according to the taper angle or the angle at the curve starting point.

As illustrated in FIG. 5(*a*), in the bottle-shaped can 1 having the curled portion 8, the liner 7*c* affixed to the inner surface of the cap 7 is contacted closely to the outer surface of the curled portion 8 from a radially inner side of the leading end section 8*b* to the lower sealing end 8*g*. Specifically, since the flexion section 8*f* shrinks radially inwardly from the diametrically-largest section 8*c*, the liner 7*c* is deformed flexibly to be contacted tightly to the portion between the diametrically-largest section 8*c* and the diametrically-shrunk section 8*d* in such a manner as to hold (or fasten) the portion between the diametrically-largest section 8*c* and the diametrically-shrunk section 8*d*. When the cap 7 is deformed by a pressure rise in the bottle-shaped can 1, the liner 7*c* is brought into contact more tightly to those sections (especially to the diametrically-shrunk section 8*d*). Therefore, the sealing ability of the bottle-shaped can 1 can be improved by shaping the curled portion 8 into the above-explained shape.

In addition, the corner portion of the cap 7 is swaged partially so that the curled portion 8 is fastened tightly by the liner 7*c*, and a fastening load is received mainly by the diametrically-largest section 8*c*. Given that the outer circumferential wall section 8*e* is shaped into the tapered shape or the curved shape expanding downwardly, the fastening load is also received by the lower sealing end 8*g*. That is, a fastening force of a portion of the liner 7*c* expanding toward the flexion section 8*f* is not as strong as a fastening force of the liner 7*c* covering the diametrically-largest section 8*c*. Therefore, when the cap 7 is rotated to be dismounted from the neck portion 4, a torque (or force) required to expand the portion of the liner 7*c* expanding toward the flexion section 8*f* to the outer diameter of the diametrically-largest section 8*c* will not be increased significantly.

Thus, according to the embodiment of the present invention, the liner 7*c* is brought into contact tightly to the diametrically-shrunk section 8*d* when the cap 7 is deformed by a pressure rise in the bottle-shaped can 1. To this end, the flexion section 8*f* is shrunk (or deformed) radially inwardly only slightly. For this reason, an adhesion area of the liner 7*c* to the diametrically-shrunk section 8*d* can be reduced when a static friction is generated in an initial phase of rotation of the cap 7, and an increase in an opening torque of the cap 7 can be prevented. In addition, in the curled portion 8 having the above-explained structure, the liner 7*c* is also contacted tightly to the outer circumferential wall section 8*e* extending below the flexion section 8*f*. For this reason, a contact area of the liner 7*c* to the curled portion 8 can be enlarged to enhance the sealing ability. Further, since the outer circumferential wall section 8*e* is shaped into the tapered shape or the curved shape expanding downwardly, an end section of the liner 7*c* is not situated radially inner side. For this reason, the opening torque of the cap 7 is not increased.

In the example shown in FIG. 5, the curled portion 8 is formed in such a manner that a folded leading edge of the two-layered folded portion 25*c* is brought into contact to a tapered portion (or a diametrically reduced portion) 13 extending from the curled portion 8 to the thread 9. Consequently, the outer circumferential wall section 8*e* is expanded outwardly due to spring back at a cylindrical portion of an inner circumferential side of the curled portion 8 and the tapered portion 13. According to the example shown in FIG. 5, therefore, the outer circumferential wall section 8*e* can be formed easily in such a manner as to increase the outer diameter thereof equal to or larger than the outer diameter of the flexion section 8*f*. In addition, a vertical load can be received by the tapered portion 13 on the occasion of mounting the cap 7 on the neck portion 4 by a so-called "roll-on capping method". Therefore, a buckling strength of the curled portion 8 or the neck portion 4 can be enhanced.

Figure 6:
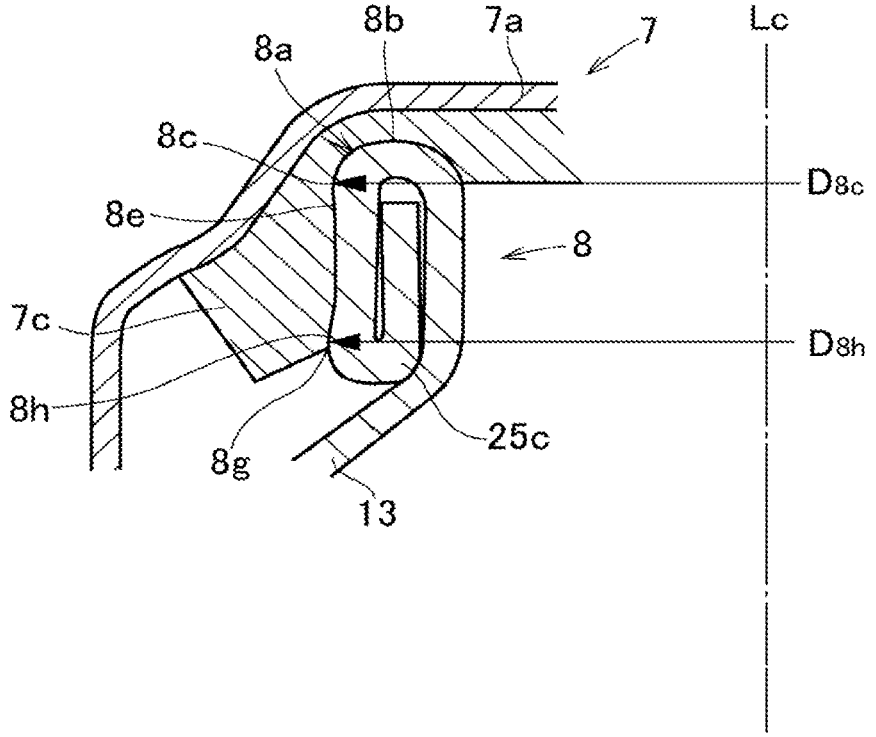
FIG. 6 is a partial schematic illustration showing an example in which a sealing linear is contacted tightly to the vicinity of a lower end of the curled portion.

As illustrated in FIG. 6, according to the present invention, the liner 7*c* may also be contacted tightly to a lower portion of the curled portion 8. According to the example shown in FIG. 6, the curled portion 8 is shaped such that a lower end arcuate section 8*h* is formed beneath the outer circumferential wall section 8*e*. The lower end arcuate section 8*h* is formed by pushing a vertically intermediate portion of the curled portion 8 from a radially outer side at the final curling step. Consequently, the lower end arcuate section 8*h* is slightly expanded radially outwardly from the outer circumferential wall section 8*e* so that a cross-sectional shape of the lower end arcuate section 8*h* along the plane passing through the center axis Lc of the neck portion 4 is expanded radially outwardly. Accordingly, a curvature center of an outer surface of the lower end arcuate section 8*h* is situated inside of the neck portion 4, and a curvature of the lower end arcuate section 8*h* is "positive" value.

The liner 7*c* extends to the lower end arcuate section 8*h* while being contacted tightly to the outer surface of the lower end arcuate section 8*h* at least partially. In the example shown in FIG. 6, the lower sealing end 8*g* is situated on the surface of the lower end arcuate section 8*h*. The lower sealing end 8*g* may also be situated on a diametrically-largest portion of the lower end arcuate section 8*h* or in the vicinity thereof, and an outer diameter D8*h* of the lower end arcuate section 8*h* may be equal to or larger than an outer diameter D8*c* of the diametrically-largest section 8*c*.

According to the example shown in FIG. 6, a contact area of the liner 7*c* to the curled portion 8 may be enlarged so that the neck portion is sealed certainly. In addition, since the diametrically-shrunk section 8*d* and the flexion section 8*f* are formed, the bottle-shaped can 1 may be maintained in a liquid-tight condition even if an internal pressure of the bottle-shaped can 1 is high. Further, since the diametrically-largest section 8*c* and the lower end arcuate section 8*h* protrude outwardly from the diametrically-shrunk section 8*d* to establish the fastening force of the liner 7*c*, a required load to expand the liner 7*c* radially outwardly when dismounting the cap 7 is rather small. For these reasons, the sealing ability of the cap 7 can be enhanced but the cap 7 can be dismounted easily.

Figure 7:
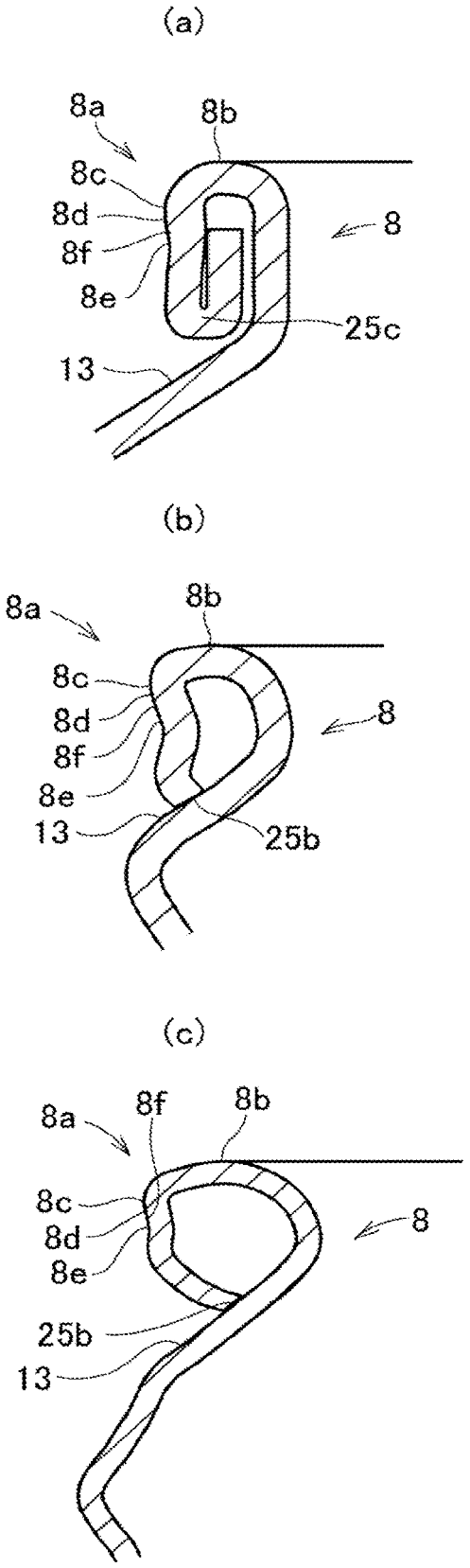
FIG. 7 is a partial schematic illustration showing other examples of the curled portion.

Other examples of the curled portion 8 is shown in FIG. 7. In the example shown in FIG. 7(*a*), the leading edge of the two-layered folded portion 25*c* is isolated slightly from the cylindrical portion of the inner circumferential side of the curled portion 8 and the tapered portion 13. In this case, the two-layered folded portion 25*c* is elastically expanded radially outwardly at around the flexion section 8*f*, therefore, the outer circumferential wall section 8*e* having an outer diameter equal to or larger than that of the flexion section 8*f* can be formed easily.

In the example shown in FIG. 7(*b*), the curled portion 8 is shaped into a hollow ring shape in which the leading edge of the leading end portion 25*b* is brought into contact to the tapered portion 13. The diametrically-largest section 8*c* is formed in the top section 8*a* by bending the leading end portion 25*b* outwardly, and the outer circumferential wall section 8*e* having a cylindrical shape, a tapered shape, or a curved shape expanding downwardly is formed beneath the diametrically-largest section 8*c* by applying a forming load thereto from the radially outer side. The diametrically-shrunk section 8*d* extends downwardly from the diametrically-largest section 8*c*, and the flexion section 8*f* is formed at a boundary between the diametrically-shrunk section 8*d* and the outer circumferential wall section 8*e*. Specifically, the outer circumferential wall section 8*e* is shaped such that the lower sealing end 8*g* is situated at an intermediate portion in the vertical direction. In the bottle-shaped can 1 according to the example shown in FIG. 7(*b*), therefore, the sealing ability of the cap 7 can be enhanced but the cap 7 can be dismounted easily, as the foregoing examples shown in FIGS. 5 and 7(*a*).

In the example shown in FIG. 7(*c*), the hollow portion of the curled portion 8 is shaped into a substantially round shape. In this case, the leading end of the portion bent outwardly is situated radially inner side of the neck portion 4, and a forming load is applied to an upper portion of the leading end from radially outer side to form the outer circumferential wall section 8*e* having a cylindrical shape, a tapered shape, or a curved shape expanding downwardly. Consequently, the diametrically-shrunk section 8*d* and the flexion section 8*f* are formed from top down between the diametrically-largest section 8*c* and the outer circumferential wall section 8*e*. In the bottle-shaped can 1 according to the example shown in FIG. 7(*c*), therefore, the sealing ability of the cap 7 can be enhanced but the cap 7 can be dismounted easily, as the foregoing examples shown in FIGS. 5, 7(*a*), and 7(*b*).

Next, here will be explained a manufacturing apparatus for manufacturing the bottle-shaped can 1 having the curled portion 8. According to the present invention, the curled portion 8 is formed by folding or rounding the leading end portion 25*b* having the opening edge. At the final forming step, the flange portion expanded radially outwardly is pushed radially inwardly while restricting a position of a leading end of the flange portion in the direction along the center axis Lc. In order to execute the final forming step, the manufacturing apparatus according to the present invention is provided with an inner tool 30 and an outer tool 31 as forming tools. One example of the manufacturing apparatus for executing the final forming step of the curled portion 8 is shown in FIG. 8.

The inner tool 30 comprises a shaft portion 30*a* that is inserted into the neck portion 4 on its leading end section, and an annular flat portion 30*b* that is expanded radially outwardly on its base portion (i.e., a base end section). For example, the folded portion 25*c* formed by folding the opening end portion of the diametrically-smaller cylindrical portion 25 radially outwardly into two layers (corresponding to a cylindrical replicated portion of the present invention) comes into contact to the annular flat portion 30*b*. On the other hand, the outer tool 31 is a ring-shaped tool whose inner diameter is larger than the curled portion 8, and is supported by a bearing 32 in a rotatable manner. In addition, the inner tool 30 and the outer tool 31 are allowed to move relatively to each other between a position at which the inner tool 30 and the outer tool 31 are aligned coaxially to each other, and a position at which the inner tool 30 and the outer tool 31 are positioned eccentrically to each other. The outer tool 31 is adapted to push the folded portion 25*c* toward the outer circumferential surface of the neck portion, and to this end, the outer tool 31 comprises a projection 31*a* formed on an inner circumferential surface at a leading end portion. A length of the outer tool 31 in the direction along the center axis Lc is substantially identical to that of the folded portion 25*c*. A predetermined clearance C is maintained between the projection 31*a* and the annular flat portion 30*b* of the inner tool 30 in the direction along the center axis Lc. Specifically, the clearance C is set wider than a length between the leading end section 8*b* and the diametrically-largest section 8*c* in the direction along the center axis Lc. That is, the manufacturing apparatus is adapted to apply a forming load to the portion of the neck portion 4 at a distance corresponding to the clearance C away from (i.e., below) the leading end portion from radially outer side.

Figure 8:
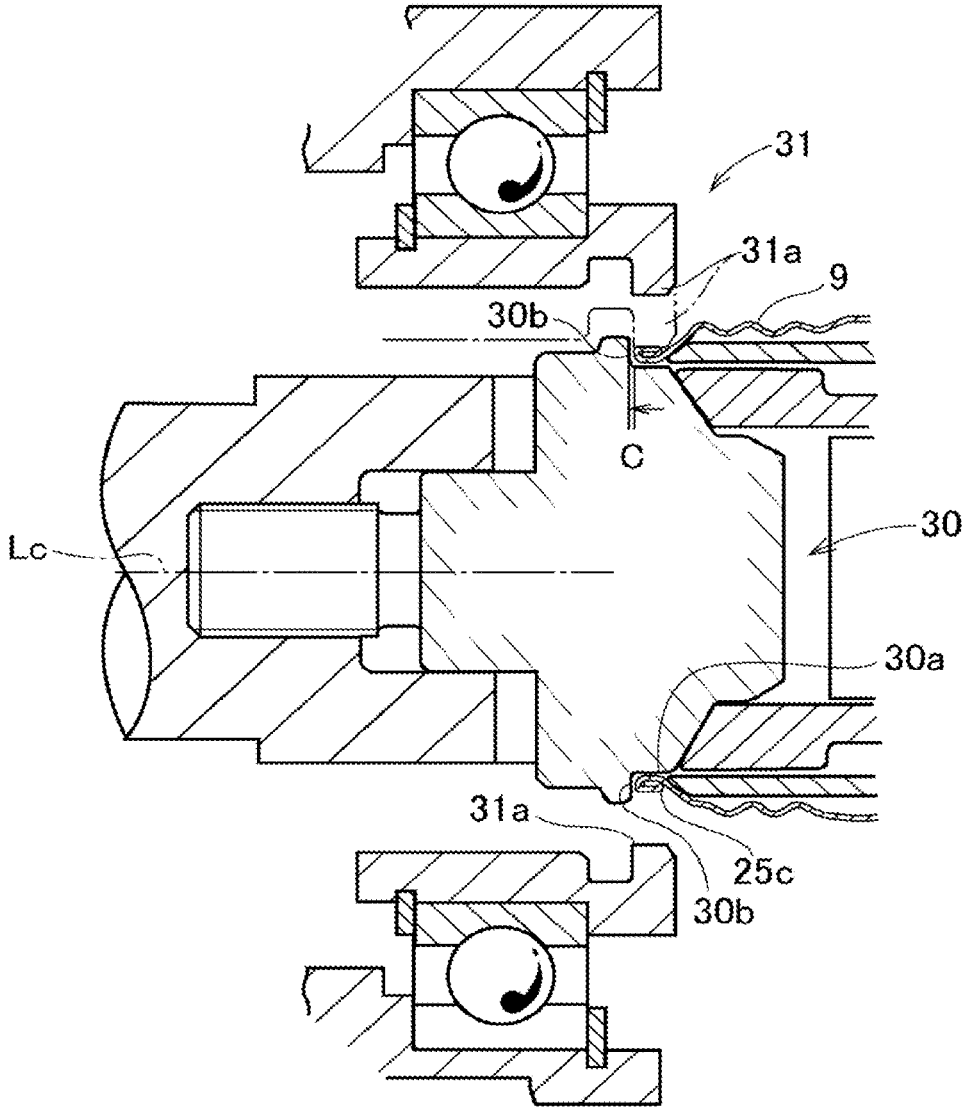
FIG. 8 is a cross-sectional view showing an inner tool and an outer tool of the manufacturing apparatus according to the present invention.

In the manufacturing apparatus shown in FIG. 8, the shaft portion 30*a* of the inner tool 30 is inserted into the diametrically-smaller cylindrical portion 25 from the leading end side so that the folded portion 25*c* is brought into contact to the annular flat portion 30*b*. In this situation, the inner tool 30 and the outer tool 31 are situated coaxially to each other while being isolated away from each other. Thereafter, the inner tool 30 is rotated together with the neck portion 4 fitted thereon while moving relatively and in parallel to the outer tool 31. Consequently, the folded portion 25*c* is partially clamped between a portion of the projection 31*a* of the outer tool 31 and the shaft portion 30*a* of the inner tool 30.

Since the outer tool 31 is supported by the bearing 32 in a rotatable manner and the inner tool 30 is being rotated, the outer tool 31 is rotated together with the neck portion 4. That is, the neck portion 4 or the folded portion 25*c* is rotated relatively along the projection 31*a* of the outer tool 31. In this situation, the lading end portion of the neck portion 4 (or the curled portion 8) is brought into contact to the annular flat portion 30*b* of the inner tool 30, therefore, the neck portion 4 does not slide on the annular flat portion 30*b*. By contrast, if a portion corresponding to the annular flat portion 30*b* is formed on the outer tool 31, the neck portion 4 would be rotated relatively to the outer tool 31 while sliding thereon. In this case, therefore, the leading end portion of the neck portion 4 or the curled portion 8 would be damaged. According to the present invention, therefore, such damage of the neck portion 4 or the curled portion 8 can be reduced or suppressed.

The folded portion 25*c* is entirely bent radially inwardly by rotating the neck portion 4 360 degrees or more, and consequently the curled portion 8 is formed. In this situation, since the clearance C is maintained between the annular flat portion 30*b* of the inner tool 30 and the projection 31*a* of the outer tool 31, the leading end portion of the curled portion 8 will not be pressed completely and a portion bulging radially outwardly remains on the leading end portion of the curled portion 8. That is, the diametrically-largest section 8*c* is formed. In addition, the outer circumferential wall section 8*e* is formed in the portion pressed by the projection 31*a* of the outer tool 31, and consequently the diametrically-shrunk section 8*d* and the flexion section 8*f* are formed between the diametrically-largest section 8*c* and the outer circumferential wall section 8*e*.

Thus, according to the present invention, the curled portion 8 comprises: the portion extending from the leading end section 8*b* to the flexion section 8*f* via the diametrically-largest section 8*c* and the diametrically-shrunk section 8*d* while smoothly bulging radially outwardly; and the tapered or curved expanding portion as the outer circumferential wall section 8*e* extending downwardly from the flexion section 8*f*. According to the present invention, the curled portion 8 having such a specific configuration may be manufactured by less steps using the simple apparatus.

Thus, the apparatus shown in FIG. 8 is adapted to form the curled portion 8 by folding the neck portion 4. However, the present invention should not be limited to the apparatus shown in FIG. 8. For example, the curled portion 8 shown in FIG. 8 may also be formed by an apparatus in which forming portions of the inner tool and the outer tool are adapted to configurations of portions (or surfaces) of a forming object to be contacted thereto. Instead, the curled portion 8 shown in FIG. 8 may also be formed by conventional rollers in which forming portions thereof are adapted to configurations of portions (or surfaces) of a forming object to be contacted thereto.

REFERENCE SIGNS LIST

1: bottle-shaped can; 2: trunk portion: 3; shoulder portion; 4: neck portion; 7: cap; 7*a*: top panel; 7*b*: skirt portion; 8: curled portion; 8*a*: top section; 8*b*: leading end section; 8*c*: diametrically-largest section; 8*d*: diametrically-shrunk section; 8*e*: outer circumferential wall section; 8*f*: flexion section; 8*g*: lower sealing end; 9: thread; 13: tapered portion; 25: diametrically-smaller cylindrical portion; 25*a*: bottom;

25*b*: leading end portion; 25*c*: folded portion; 30: inner tool; 30*a*: shaft portion; 30*b*: annular flat portion; 31: outer tool; 31*a*: projection; C: clearance; Lc: center axis.

The invention claimed is:

1. A bottle-shaped can with a cap, comprising:

a neck portion on which a thread is formed, and on which the cap is mounted; and a curled portion formed on an upper end portion of the neck portion, to which a sealing member affixed to an inner surface of the cap is contacted tightly to seal the neck portion;

wherein the curled portion includes a smooth top section formed by folding an end portion of a metallic seat forming the neck portion radially outwardly, wherein:

the top section includes a leading end section as an upper end of the neck portion, a diametrically-largest section formed beneath the leading end section in which an outer diameter is largest, a diametrically-shrunk section extending downwardly from the diametrically-largest section in which an outer diameter is reduced gradually, and an outer circumferential wall section extending downwardly from the diametrically-shrunk section, the leading end section, the diametrically-largest section, and the diametrically-shrunk section form a smooth curved surface, a curvature of the outer circumferential wall section in a cross-section along a plane passing through a center axis of the neck portion is zero or negative value, given that a curvature of the diametrically-shrunk section is positive value, a flexion section is formed between the diametrically-shrunk section and the outer circumferential wall section, the outer diameter of the outer circumferential wall section in which the curvature is zero or negative value is larger than an outer diameter of the flexion section, wherein the outer circumferential wall section in which the curvature is zero or negative value is shaped into a tapered shape in which the outer diameter is gradually increased downwardly, or a curved shape expanding downwardly, and wherein an outer diameter of a lower sealing end as a lowest portion, to which the sealing member is contacted in the outer circumferential wall section shaped into the tapered shape or the curved shape expanding downwardly, is equal to or larger than the outer diameter of the diametrically-largest section.

2. The bottle-shaped can with the cap as claimed in claim 1, wherein the sealing member is contacted closely to the surface of the curled portion from the leading end section to at least a portion below the flexion section of the outer circumferential wall section.

3. The bottle-shaped can with the cap as claimed in claim 1, wherein a taper angle of the outer circumferential wall section in which the curvature is zero or negative value, or an angle between a tangent line at a curve starting point where the outer circumferential wall section starts expanding and the center axis is equal to or larger than 1 degree but equal to or smaller than 15 degrees.

4. The bottle-shaped can with the cap as claimed in claim 3, wherein a lower end arcuate section is formed beneath the outer circumferential wall section, and a curvature of the lower end arcuate section is positive value so that the cross-section of the lower end arcuate section along the plane passing through the center axis of the neck portion expands radially outwardly.

5. The bottle-shaped can with the cap as claimed in claim 1, wherein a lower end arcuate section is formed beneath the outer circumferential wall section, and a curvature of the lower end arcuate section is positive value so that the cross-section of the lower end arcuate section along the plane passing through the center axis of the neck portion expands radially outwardly.

6. A manufacturing apparatus of a bottle-shaped can with a cap, comprising:

a neck portion on which a thread is formed, and on which the cap is mounted; and a curled portion formed on an upper end portion of the neck portion, to which a sealing member affixed to an inner surface of the cap is contacted tightly to seal the neck portion, wherein the curled portion has a top section including a leading end section as an upper end of the neck portion, a diametrically-largest section formed beneath the leading end section in which an outer diameter is largest, a diametrically-shrunk section extending downwardly from the diametrically-largest section in which an outer diameter is reduced gradually, and an outer circumferential wall section extending downwardly from the diametrically-shrunk section, wherein:

the manufacturing apparatus comprises a forming tool that pushes a cylindrical folded portion bent outwardly from the neck portion toward an outer circumferential surface of the neck portion to form the curled portion, the forming tool includes an inner tool that is inserted into the neck portion to maintain a shape of the neck portion from inside, and an outer tool that pushes the folded portion toward the neck portion from radially outer side, the inner tool includes a shaft portion which is inserted into the neck portion, and an annular flat portion to which a leading end of the folded portion formed on the neck portion is contacted, the outer tool includes a projection that is isolated from the annular flat portion at a distance wider than a length between the leading end section and the diametrically-largest section in a direction along a center axis of the neck portion, and that pushes the folded portion toward the neck portion from radially outer side, and the neck portion engaged with the inner tool is rotated along the outer tool to form the curled portion.

7. A bottle-shaped can with a cap, comprising:

a neck portion on which a thread is formed, and on which the cap is mounted; and a curled portion formed on an upper end portion of the neck portion, to which a sealing member affixed to an inner surface of the cap is contacted tightly to seal the neck portion;

wherein the curled portion includes a smooth top section formed by folding an end portion of a metallic seat forming the neck portion radially outwardly, the top section includes a leading end section as an upper end of the neck portion, a diametrically-largest section formed beneath the leading end section in which an outer diameter is largest, a diametrically-shrunk section extending downwardly from the diametrically-largest section in which an outer diameter is reduced gradually, and an outer circumferential wall section extending downwardly from the diametrically-shrunk section, the leading end section, the diametrically-largest section, and the diametrically-shrunk section form a smooth curved surface, a curvature of the outer circumferential wall section in a cross-section along a plane passing through a center axis of the neck portion is zero or negative value, given that a curvature of the diametrically-shrunk section is positive value, a flexion section is formed between the diametrically-shrunk section and the outer circumferential wall section, the outer diameter of the outer circumferential wall section in which the curvature is zero or negative value is larger than an outer diameter of the flexion section, a lower end arcuate section is formed beneath the outer circumferential wall section, and a curvature of the lower end arcuate section is positive value so that the cross-section of the lower end arcuate section along the plane passing through the center axis of the neck portion expands radially outwardly, the lower sealing end as the lowest portion to which the sealing member is contacted is situated at a predetermined site of a surface of the lower end arcuate section, and wherein an outer diameter of the lower sealing end is equal to or larger than the outer diameter of the diametrically-largest section.

8. The bottle-shaped can with the cap as claimed in claim 7, wherein the sealing member is contacted closely to the surface of the curled portion from the leading end section to at least a portion below the flexion section of the outer circumferential wall section.

9. The bottle-shaped can with the cap as claimed in claim 8, wherein the outer circumferential wall section in which the curvature is zero or negative value is shaped into a tapered shape in which the outer diameter is gradually increased downwardly, or a curved shape expanding downwardly.

10. The bottle-shaped can with the cap as claimed in claim 7, wherein the outer circumferential wall section in which the curvature is zero or negative value is shaped into a tapered shape in which the outer diameter is gradually increased downwardly, or a curved shape expanding downwardly.

* * * * *